United States Patent [19]

Scheffel

[11] 4,371,007

[45] Feb. 1, 1983

[54] PICKING METHOD AND APPARATUS ON TEXTILE LOOMS INVOLVING THE USE OF A FLUID MEDIUM

[76] Inventor: Walter Scheffel, Hopfenstrasse 14, Weissenburg/Bayern, Fed. Rep. of Germany

[21] Appl. No.: 191,241

[22] PCT Filed: Jun. 12, 1979

[86] PCT No.: PCT/CH79/00087

§ 371 Date: Feb. 12, 1980

§ 102(e) Date: Feb. 12, 1980

[87] PCT Pub. No.: W080/00087

PCT Pub. Date: Jan. 24, 1980

[30] Foreign Application Priority Data

Jun. 12, 1978 [DE] Fed. Rep. of Germany ..... 2825679

[51] Int. Cl.[3] ..... D03D 47/30

[52] U.S. Cl. ..... 139/435

[58] Field of Search ..... 139/435; 226/97

[56] References Cited

U.S. PATENT DOCUMENTS 1,721,940 7/1929 Ballou ..... 139/435

3,847,187 11/1974 Buran et al. ..... 139/435

FOREIGN PATENT DOCUMENTS 1801044 7/1969 Fed. Rep. of Germany .

2145256 3/1972 Fed. Rep. of Germany .

2608030 9/1977 Fed. Rep. of Germany ..... 139/435

2622148 11/1977 Fed. Rep. of Germany ..... 139/435

*Primary Examiner*—Henry Jaudon

*Attorney, Agent, or Firm*—Karl F. Ross

[57] ABSTRACT

In an apparatus for the fluid insertion of the weft in a loom which comprises a swingable sley extending across the loom and carrying a reed for the battening of a weft inserted into a warp shed formed by warp threads extending through the reed transversely to the sley and wherein the sley is formed with a weft channel extending across the loom and swingable into a warp shed formed by separating lower warp threads from upper warp threads, the channel being provided with a plurality of nozzles at spaced locations across the loom and oriented to carry a weft pick through the channel in the shed, the channel being formed by a plurality of yarn guides extending between the warp yarns and the channel having a generally V-shaped cross section opening towards the reed with upper flanks delimiting the upper side, rear flanks delimiting the rear and lower flanks delimiting the lower side of said channel, the improvement wherein the upper and rear flanks of the cross section of the channel are formed by first yarn guides and the lower flanks are formed by second yarn guides and the second yarn guides are spacedly arranged between the first yarn guides.

4 Claims, 14 Drawing Figures

PICKING METHOD AND APPARATUS ON TEXTILE LOOMS INVOLVING THE USE OF A FLUID MEDIUM

FIELD OF THE INVENTION

The invention relates to an apparatus on textile looms using a fluid for guiding and transporting the weft yarn in the shed in a channel formed by yarn guides.

BACKGROUND OF THE INVENTION

Known apparatus for performing such operations, in which the yarn guides forming the weft transport channel are fixedly connected to the sley and have a "C", or "V" shaped cross section of the channel with an opening towards the reed side, are disclosed for example in German patent documents Nos. 2,622,148 and 2,608,030.

A channel terminating with a rounded portion and in its vertical clearance tapering away from the reed plane, offers an optimum weft thread transport with low energy requirements.

However, the weaving speeds are limited then by the allowable speed of the devices required for forming the shed, so that it is necessary with increasing weaving speeds to reduce the lift of the shed in order to reduce the inertial forces.

This is achieved by reducing the height of the channel perpendicular to the bisecting plane of the upper and lower yarn threads of the shed.

Therefore the known yarn transport channel has a slim "V" or "C" shaped cross section and the legs of the "V" or "C" are nearly parallel to the warp threads when the shed is opened. A slim "V" means that the angle between the upper and lower legs of the "V" is small and so the height of the channel is also small.

The problem of such a channel is the introduction into the warp threads of the lower yarn.

In known apparatus, the upper yarn guide leg enters the group of warp threads of the lower shed, completing this separation via the lower leg of the yarn guide.

The angle between the lower leg of the "V" and the warp threads of the lower shed is important for troublefree penetration of the yarn guide into the shed. In case of a certain lateral displacement of the warp threads, and a lower leg of the "V" being almost parallel to the lower yarn of the shed, there is a danger that the warp threads may not slide down to the bottom of the guides, but will be positioned in crossed manner over the lower leg of the "V".

This lateral displacement may particularly happen in the case of large weaving widths and especially in the vicinity of the stretcher.

Such a warp thread, which is caught on the lower leg of the "V" will cause picking faults because it influences the fluid stream by exposing its filaments to the channel.

SUMMARY OF THE INVENTION

According to the invention, for a reliable, troublefree introduction into the warp threads, two different yarn guide configurations are used in a channel.

The transport channel contains first yarn guides, which form the upper leg of the V-shaped channel and second yarn guides, which form the lower leg of the "V". Viewed in the direction of the weft insertion, both types of yarn guides together form a V-shaped cross section of the channel. The cross section of the channel has a rounded termination between the two legs of the "V" which is unitary with the upper leg of the "V" and therefore is part of every first yarn guide. The second yarn guides are spacedly arranged between the first yarn guides.

As a result of this novel arrangement of the first and second yarn guides, the penetration of the lower leg of the "V" cannot cause a caught lower yarn. The second yarn guides, being separate from the first yarn guides, allow the yarn to slide down to the bottom of the yarn guides. If there is no yarn caught on the lower leg of the "V" and thus exposed to the fluid stream and weft, no picking fault can be caused.

BRIEF DESCRIPTION OF THE DRAWING

The above and other features and advantages of the invention will become more readily apparent from the following description, reference being made to the accompanying drawing, in which.

SPECIFIC DESCRIPTION

Figure 3:
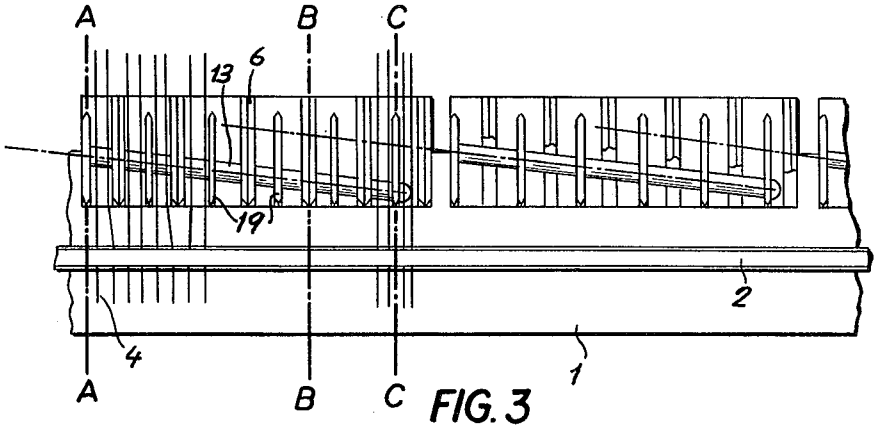
FIG. 3 is a top view of the apparatus of FIG. 1.
Figure 2:
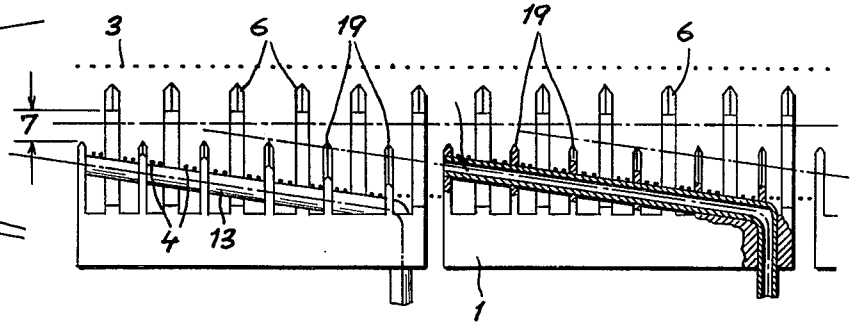
FIG. 2 is a front elevational view of the apparatus of FIG. 1.
Figure 1:
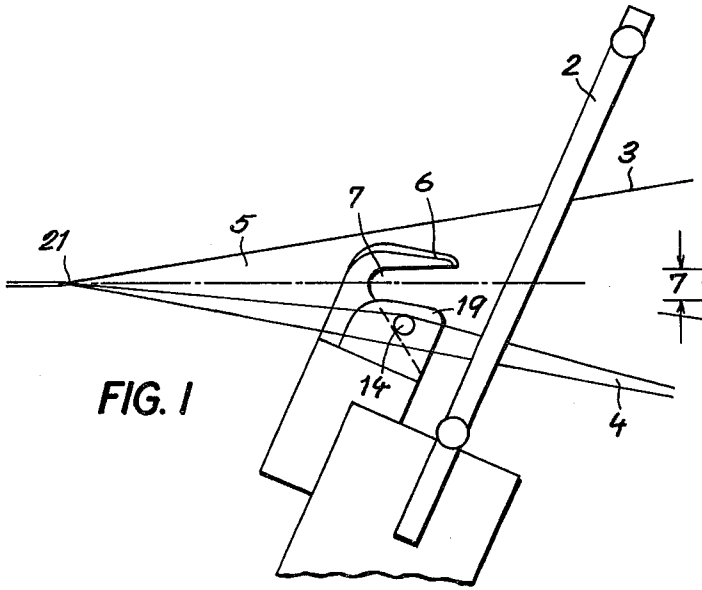
FIG. 1 is a side view of the picking apparatus according to the invention.

According to FIGS. 1, 2, 3*a*, 3*b*, 3*c* and 4 the sley 1 has a weft transport channel 7 which is intended to swing into and out of the shed 5 formed by the warp threads 3 and 4. This channel 7 is formed by a plurality of first and second yarn guides 6 and 19 which also are separators for the warp threads 3 and 4. These first yarn guides 6 and second yarn guides 19 have different shapes. The channel 7 has a generally V-shaped profile with an upper flank, a rear flank and a lower flank. The upper flank and the rear flank are formed by the first yarn guides 6. The first yarn guides 6 are aligned to impart a similar cross section to the channel 7 and are spaced apart with the second yarn guides 19 being displaced between them. Most of the second yarn guides 19 have upper edges extending above the lower flanks of the first yarn guides 6, so that they in effect define the bottom of the channel 7.

Flow discharge openings 14 are formed at spaced locations across the loom in yarn guides 19 and are positioned near the lower leg of the "V" toward the reed side of the channel 7. They are directed in such a way that the axis of the discharge flow has a distance increasing downstream away from the reed plane, while the distance of the axis from the upper leg of the "V" decreases downstream, towards the channel axis.

To allow undisturbed discharge flow from the flow discharge openings 14 to the rounded termination of the V-shaped cross section of the channel 7, it is favorable that the angle between the legs of the "V" has a maximum which decreases downstream right after each discharge opening 14.

Because the upper legs of the "V", formed by the first yarn guides 6, are all aligned, the decreasing angle of the "V" is achieved by changing the inclination of the lower leg of the "V". The inclination of the lower leg of the "V" is defined by the shape of the second yarn guides 19. Therefore the shape of the second yarn guides 19 has to differ from yarn guide to yarn guide. The shape of the first yarn guides 6 can be the same for all.

Figure 3C:
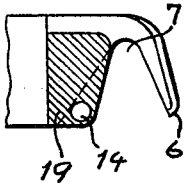
FIG. 3*c* is a sectional view taken along line e—e of FIG. 3.
Figure 3B:
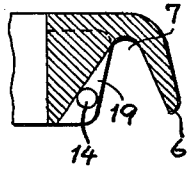
FIG. 3*b* is a sectional view taken along line B—B of FIG. 3.
Figure 3A:
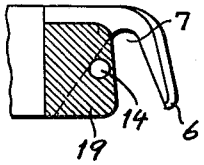
FIG. 3*a* is a sectional view taken along line A—A of FIG. 3.

This is specifically shown in FIGS. 3*a*, 3*b* and 3*c* which contain three sectional views of the channel 7 taken at three different positions in the direction of the axis of the channel 7. Section A—A is the narrowest position of the channel 7 and section C—C is the widest position. It can be seen that the opening width of the channel 7 is only controlled by the shape of the second yarn guide 19.

Section B—B of FIG. 3*b* shows especially the shape of the first yarn guide 6 which can be the same for all the yarn guides 6 incorporated in the channel 7. The supply tubes 13 of the discharge openings 14 penetrate the lower yarn guides 19.

Figure 4:
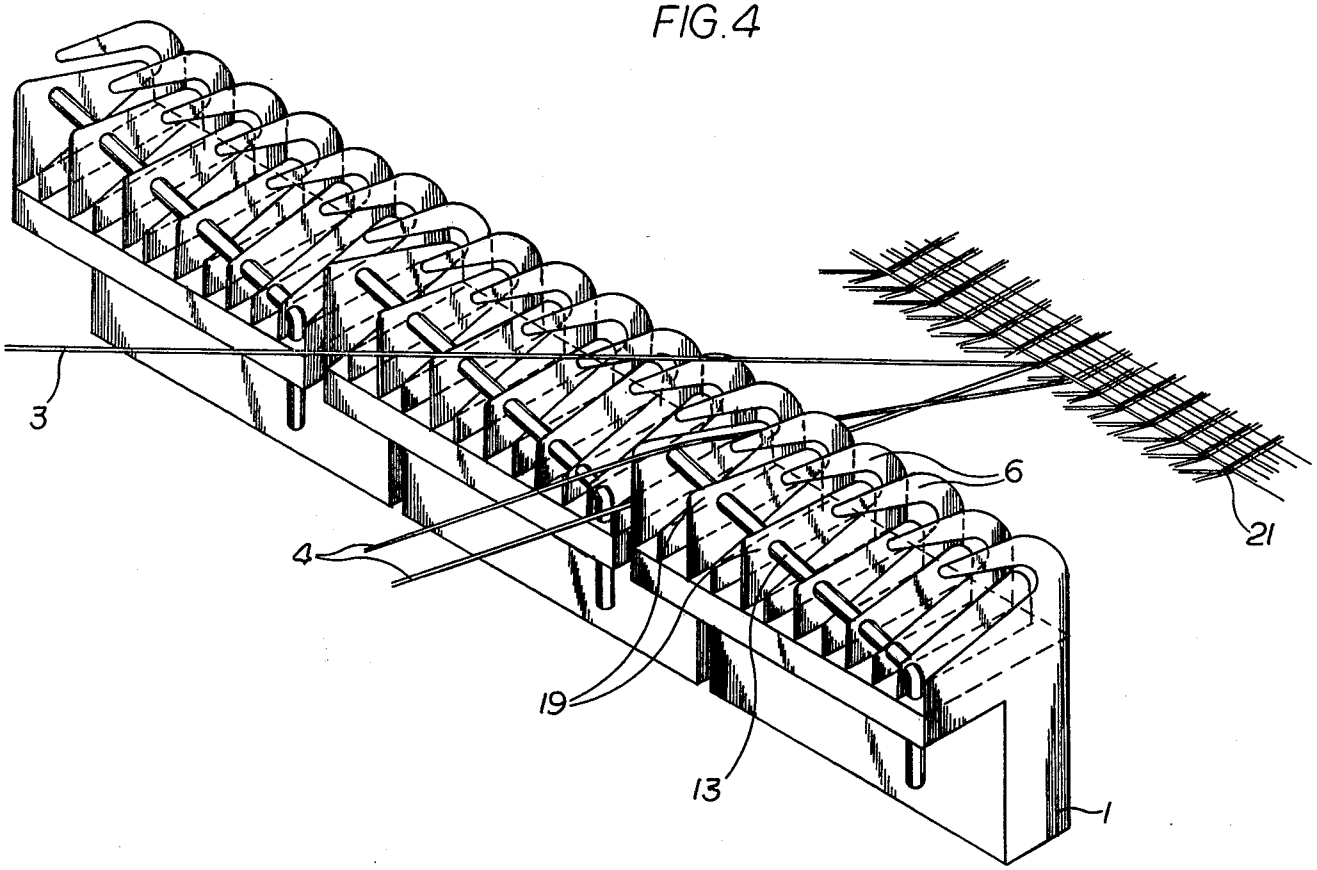
FIG. 4 is a perspective view of the apparatus of FIGS. 1, 2 and 3 showing the supply tubes penetrating the second yarn guides.

FIG. 4 is a perspective view of the arrangement described above.

More specifically, the sley 1 has its weft-transport channel 7, which is intended to swing into and out of the shed formed by the warp, constituted by a plurality of first and second guides 6 and 19 which also form separators between the warp threads. These flat guides have different shapes so that, for example, the guides 6 can have a generally V-shaped profile with an overhanging flank, a rear flank and a lower flank. The V-shaped guides 6 are aligned to impart a similar cross section to the channel and are spaced apart with the guides 19 being displaced between them. The guides 19 have upper edges extending above the lower flanks and curb downwardly away from the reed side so that they, in effect, define the bottom of the channel as seen in profile. Since the lower flanks of members 6 slope downwardly sharply, fiber debris cannot accumulate in the channel and the fluid supply tubes extend upwardly therein to allow the lower warp threads, during shed formation, to rest on these tubes while being separated by the members 19. When fluid streams are delivered by these tubes to the respective nozzles which are oriented in the direction of travel of the weft, the pick is carried through the shed into which the channel has been inserted, whereupon the channel is retracted out of the shed to permit the weft to be engaged by the reed.

Figure 5:
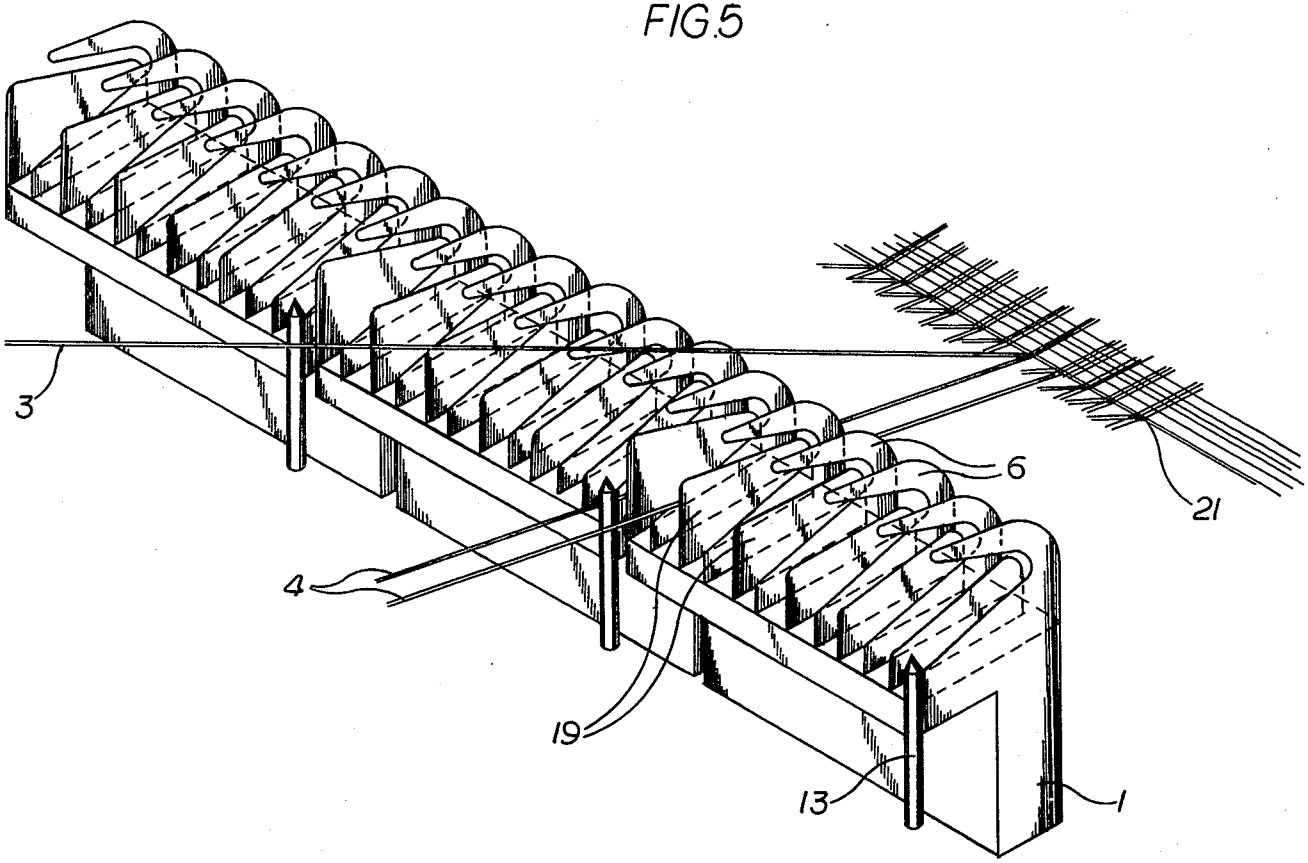
FIG. 5 is a perspective view similar to FIG. 4 showing a picking apparatus in which the supply lines do not penetrate the second yarn guides.

As shown in FIG. 5, the supply tubes 13 of the discharge openings 14 do not have to penetrate the lower yarn guides 19 if they are outside of the structure which is formed by the yarn guides 6 and 19, and have their openings 14 positioned at the beginning of the channel 7 and directed downstream at the proper inclination.

FIGS. 6*a*–6*f* are related and show three phases of the interaction between the yarn guides 6 and 19 and the warp yarn 3 and 4.

Figures 6A, 6B, 6C, 6D, 6E, 6F:
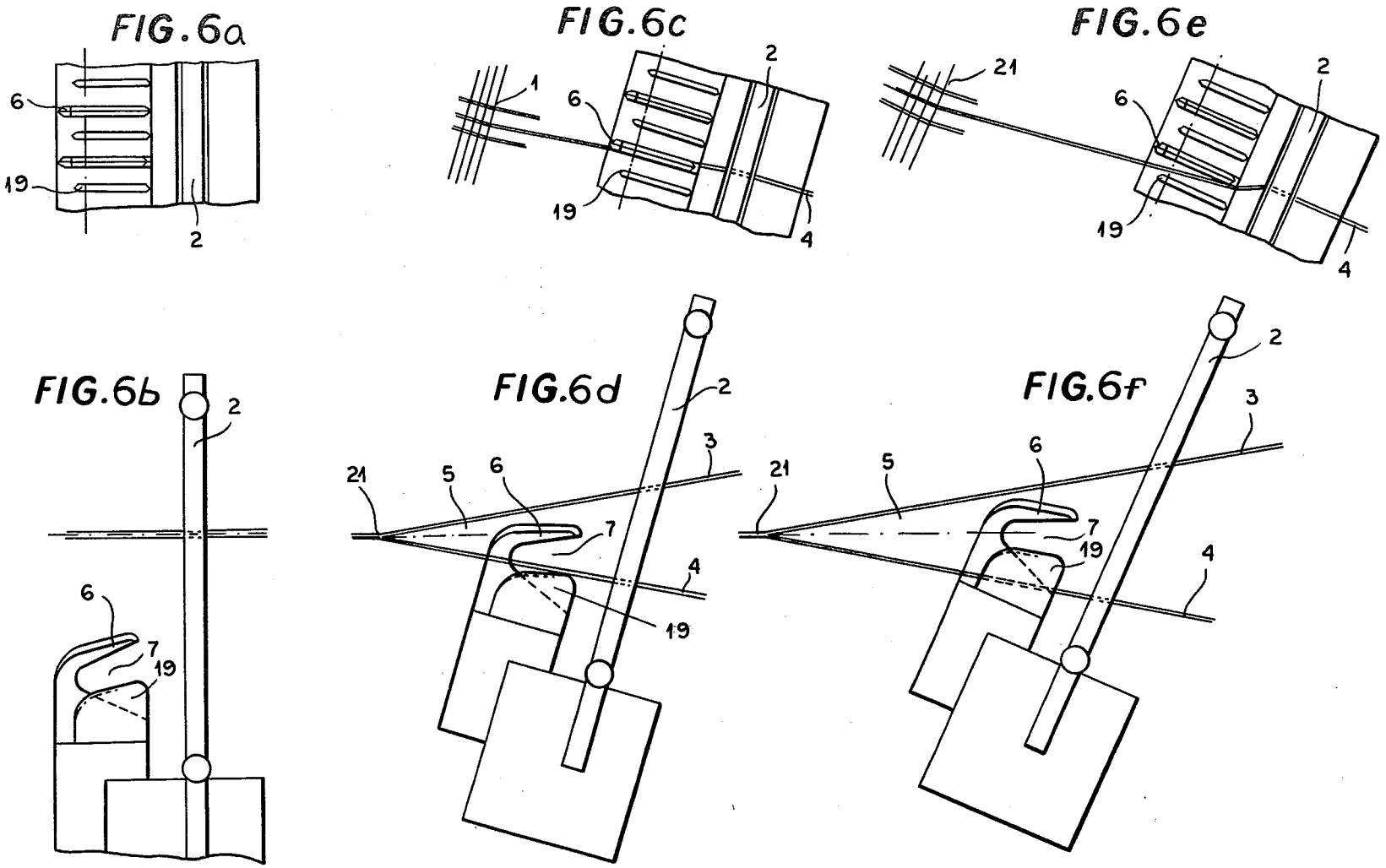
FIGS. 6*a* and 6*b* are respectively, a plan view and a side view of the picking apparatus in the closed shed position.
FIGS. 6*c* and 6*d*, are respectively, a plan view and a side view of the picking apparatus showing the second yarn guide at the moment of penetration between the lower threads of the shed.
FIGS. 6*e* and 6*f* are respectively, a plan view and a side view of the picking apparatus in the fully open shed position.

At FIGS. 6*a* and 6*b*, the reed 2 is in the beatup position, the shed is closed and there is no contact between the yarn guides 6 and 19 and the warp yarn 3 and 4.

In the side view of FIG. 6*d*, the channel 7 is almost inside of the shed 5. The first yarn guide 6 has penetrated the lower warp yarn 4 with its upper leg and the second yarn guide 19 is just about to enter the warp between the lower warp yarn 4. The plan view of FIG. 6*c* shows a lateral displacement of the warp yarn 3 and 4 relative to the reed 2, as it happens on wide looms.

Coming from the reed the lower warp yarn 4 arrives at the right side plane of yarn guide 6. On its path to the fell 21 the lower warp yarn 4 passes by the first yarn guide 6 and arrives at its left side when it leaves it.

If the cross sectional shape of the channel 7 was formed out of one yarn guide instead of two, any further penetration of the channel 7 into the shed would cause the lower warp yarn 4 to get caught in a crossed manner over the lower leg which forms the bottom of the channel.

According to the invention, however, the bottom of the channel 7 is formed by the yarn guides 19 which are positioned separately between the yarn guides 6. During further penetration of the channel 7 into the shed, the lower warp yarn 4 will slide down along the yarn guide 6, even if laterally displaced as shown. The lower leg of the yarn guide 6 has no specific function and is inclined steeply which supports the slide down of the lower warp yarn 4.

FIGS. 6*e* and 6*f* show the final position of the channel 7 within the shed.

I claim:

1. In an apparatus for the fluid insertion of the weft in a loom which comprises a swingable sley extending across the loom and carrying a reed for the battening of a weft inserted into a warp shed formed by warp threads extending through said reed transversely to said sley and wherein said sley is formed with a weft channel extending across said loom and swingable into a warp shed formed by separating lower warp threads from upper warp threads, said channel being provided with a plurality of nozzles at spaced locations across the loom and oriented to carry a weft pick through said channel in said shed, the improvement wherein said channel is formed by a plurality of flat first yarn guides extending between said warp yarns and of generally V-shaped profile opening toward said reed with upper flanks defining the upper side of said channel, rear flanks defining the rear of said channel and lower flanks, and second flat guides extending between the lower warp threads and spaced apart between said first guides, said second guides having upper edges disposed below said upper flanks and at least in part defining a bottom of said channel whereby the first guides pass through the warp at different positions from said second guides, said lower flanks being inclined downwardly toward said reed below said upper edges of said second guides.

2. The improvement defined in claim 1 wherein said second guides have round rear portions adjoining their upper edges and turned away from said reed.

3. The improvement defined in claim 2, further comprising flat third guides spaced between said first and second guides and extending between lower warp threads at least in a position wherein said channel is swung into said shed, said third guides having upper edges inclined downwardly toward said reed with an inclination different from the inclination of the upper edges of said second guides and of said lower flanks.

4. The improvement defined in claim 2 wherein said reed battens a weft in a closed-shed yarn plane and said upper flanks and said upper edges lie substantially parallel to said yarn plane when said channel is in said shed for a weft pick.

* * * * *